US009388540B2

(12) United States Patent
Koering

(10) Patent No.: US 9,388,540 B2
(45) Date of Patent: Jul. 12, 2016

(54) REMOVABLE BRACKET FOR A WALKWAY HANDRAIL

(71) Applicant: Brad Koering, Brainerd, MN (US)

(72) Inventor: Brad Koering, Brainerd, MN (US)

(73) Assignee: Brad Koering, Brainerd, MN (US)

( * ) Notice: Subject to any disclaimer, the term of this patent is extended or adjusted under 35 U.S.C. 154(b) by 445 days.

(21) Appl. No.: 13/787,518

(22) Filed: Mar. 6, 2013

(65) Prior Publication Data

US 2014/0252291 A1 Sep. 11, 2014

(51) Int. Cl.

| | |
|---|---|
| ***E04H 17/14*** | (2006.01) |
| ***E01D 19/10*** | (2006.01) |
| ***B66B 23/24*** | (2006.01) |
| *E04G 5/14* | (2006.01) |

(52) U.S. Cl.

CPC ..... *E01D 19/103* (2013.01); *B66B 23/24* (2013.01); *E04G 5/14* (2013.01); *E04G 5/145* (2013.01); *Y10T 29/49947* (2015.01)

(58) Field of Classification Search

None

See application file for complete search history.

(56) References Cited

U.S. PATENT DOCUMENTS

| | | | | |
|---|---|---|---|---|
| 2,531,563 | A * | 11/1950 | Feldheim | E04G 21/00 248/231.41 |
| 3,615,110 | A * | 10/1971 | Fugate | 403/230 |
| 3,647,078 | A * | 3/1972 | Fortunato | A47F 5/0068 211/134 |
| 3,995,833 | A * | 12/1976 | McLaughlin et al. | 256/59 |
| 4,919,394 | A * | 4/1990 | Otte | E04F 11/1817 256/59 |
| 6,173,809 | B1 * | 1/2001 | Cole et al. | 182/3 |
| 6,585,080 | B2 * | 7/2003 | Murray | E04G 21/3233 182/113 |

* cited by examiner

*Primary Examiner* — Matthieu Setliff

(74) *Attorney, Agent, or Firm* — Lewis Rice LLC

(57) ABSTRACT

A bracket for attaching a safety handrail to a walkway comprising a C-shaped clamp with a retaining brace which slides under the lower flange of a metal walkway side rail, and is attached using a fastener. The back of the clamp has a retaining sleeve for holding a board for a safety handrail.

6 Claims, 4 Drawing Sheets

REMOVABLE BRACKET FOR A WALKWAY HANDRAIL

BACKGROUND

1. Field of the Invention

This disclosure relates to handrails, in particular to systems, methods, and devices for quickly installing and removing handrails on walkways commonly used in construction and industrial facilities.

2. Description of the Related Art

Metal walkways are ubiquitous in industrial facilities and construction sites. These elevated platforms are used to quickly provide access to remote areas of a work site or to provide a bridge between two elevated areas.

These walkways are generally comprised of two side beams, often I-beams, arranged generally in parallel and connected at fixed intervals by crossbars to create an elongated rectangular grid of square openings. Metal grating placed in the openings provides a high-friction, low-slip surface for workers to walk on. A common technique is to use expanded metal grating with a high-friction texture on one side. These walkways are constructed of durable but relatively lightweight metals—often aluminum, carbon steel, or stainless steel—allowing them to withstand the rigors and stress of an industrial job site while still being inexpensive to transport, install, and take down.

Metal walkways are not without their shortcomings. For one, such walkways are often installed at heights far enough above the ground that if a worker slips or falls from the walkway, the impact may cause serious injury or death. Further, materials inadvertently kicked or dropped from such heights pose a serious risk of injury to those on the ground. In typical industrial applications, work materials and tools are usually heavy and, thus, are more likely to be dropped and more likely to cause serious harm. Further, workers hustling about a busy work site quickly become accustomed to navigating the metal walkways and gain confidence in its stability. As they become comfortable with the work site and move more quickly about the work site, they may tend to exercise less caution, which can increase the risk of a trip and fall. Further, as the work site becomes more congested with tools and materials, stray objects left on a walkway may pose an increased tripping hazard.

Injuries from workplace-related falls impose an enormous burden on the economy, as well as on employers, workers, and their families. In 2011, the Bureau of Labor Statistics reported that almost 30% of all workplace related injuries requiring days away from work were caused by the worker either falling or being struck by equipment, and laborers accounted for the highest proportion of injuries and illness in the private sector, experiencing such injuries at a rate three times greater than the private sector industry average, with a median recovery time of nine days. This problem is only exacerbated with respect to metal walkways, which are generally elevated and thus falls from them tend to be more dangerous.

Government regulations require safety handrails for walkways more than six feet above ground, but safety handrails are recommended for any application, no matter how low to the ground. Regardless, many walkways are manufactured without handrails, such as to make pieces more standardized, and there is no simple or effective way to secure handrails to such walkways. Because the sides of the walkway are generally comprised of metal beams, hardware cannot be quickly or easily attached to secure a safety handrail to the walkway.

Further, permanently adding support for a handrail is often undesirable or impossible, such as where the walkways are leased, rented, or borrowed.

In many applications, safety handrails also need to be installed in unusual configurations, or in lengths not available in off-the-shelf products. Manufacturing custom metal handrails is time-consuming and expensive, and attaching them to the walkway can damage the walkway. Further, and as discussed, the crew may not be at liberty to modify the walkway in this fashion. Even where custom handrails are an option, there may not be enough time to craft and install them. Walkways are often erected on short notice, such as in an emergency situation, and the circumstances simply cannot wait for metal rails to be measured, cut, welded, and allowed to cool.

Further, custom metal handrails are expensive and once the job is completed, they generally can't be re-used, resulting in wasted time, money, and materials. Repairs to such handrails are also expensive and difficult, requiring a metalworker on site with access to proper metalworking tools and materials, who can cut metal to length and weld the pieces together. Metal is difficult, expensive, and time-consuming to work, often requiring specialized saw blades and dangerous tools such as high-temperature welding equipment. The repairs must also be given time to cool and bond, during which the walkway is less safe, and may be non-compliant with applicable safety regulations. Further, metal cuts leave sharp barbs which, if not filed, can snag clothing and cause injury to personnel and damage to equipment.

It is preferable to use cheaper and more flexible materials for custom handrails, such as wood. Wood is almost universally available at any job site, and milled boards come in a number of standard cuts. Most enterprises have at least one worker skilled in woodworking and the use of woodworking tools, and most enterprises have at least a basic set of wood cutting and shaping tools on site. Wood is easy, fast, and cheap to saw to length and attach, and can be quickly broken down and repurposed for other uses with minimum waste. Wood does not require dangerous welding equipment, and hardware joints needn't be given time to cure. Further, the ends of properly cut wood are generally smooth and can be made safe without extensive filing or sanding.

However, attaching a wooden handrail to a metal walkway is difficult. For walkways manufactured with receptacles for handrails, these receptacles are sized and shaped for metal handrails, which are generally round and, in any case, not sized to accept any standard size of milled lumber. Further, wood cannot be simply nailed or screwed to metal walkways using ordinary woodworking hardware because such hardware cannot penetrate metal. Special metalworking hardware is necessary, but such hardware is generally unsuitable for use with wood, and may cause splitting or splintering, reducing the integrity of the wood and comprising the stability of a handrail constructed therefrom. Further, walkways are often leased, rented, or borrowed and the crew is not at liberty to put holes into the walkways regardless, nor is it desirable to puncture holes in a metal walkway to attach a safety handrail. The stress placed on the handrail through ordinary use also would tend to weaken a hardware joint over time, wearing down the wood near the joinery until it splits or the hardware loosens and works its way out, causing the joinery to fail, the handrail to collapse, and defeating the purpose of erecting it.

SUMMARY

The following is a summary of the invention in order to provide a basic understanding of some aspects of the invention. This summary is not intended to identify key or critical elements of the invention or to delineate the scope of the invention. The sole purpose of this section is to present some concepts of the invention in a simplified form as a prelude to the more detailed description that is presented later.

Because of these and other problems in the art, described herein, among other things, are devices, systems, and methods for attaching wooden safety handrails to metal walkways in a secure fashion without permanently modifying the metal walkway, including but not limited to a removable bracket for attaching a wooden safety handrail to a metal walkway, wherein the bracket can be quickly attached to and removed from the walkway without structurally altering the walkway, allowing a safety handrail to be quickly and inexpensively sized and shaped as needed from wooden boards.

Described herein, among other things, is a bracket for attaching a safety handrail to a walkway comprising: a generally C-shaped clamp, including: a body having opposing top and bottom ends and opposing front and back sides; a top portion having opposing proximal and distal ends; a bottom portion having opposing proximal and distal ends; a rectangular brace; wherein the brace is generally perpendicularly connected to the distal end of the top portion and extends ventrally therefrom; wherein the proximal end of the top portion is generally perpendicularly connected to the top end of the body; wherein the proximal end of the bottom portion is generally perpendicularly connected to the bottom end of the body; a retaining sleeve generally in the shape of a hollow rectangular prism having an open top side, the sleeve rigidly attached to the back of the body such that when an elongated generally linear board is inserted into the sleeve through the open top side the board is generally parallel to the body.

In an embodiment, the clamp further comprises a fastening system.

In an embodiment, the fastening system comprises an aperture in the bottom portion sized, shaped, and positioned on the bottom portion such that when the clamp is attached to a walkway. A fastener is inserted through the aperture and must be at least partially withdrawn before the clamp is removed from the walkway.

In an embodiment, the fastening system further comprises a nut rigidly attached to the bottom portion such that the nut circumscribes the aperture.

In an embodiment, the fastener is a bolt.

In an embodiment, the distance between the body and the brace along the top portion is less than the distance between the body and the aperture along the bottom portion.

In an embodiment, the sleeve further comprises an aperture sized and shaped to accommodate a fastener, the aperture positioned on the sleeve such that when a board is in the sleeve, a fastener inserted through the aperture will penetrate the board.

In an embodiment, the fastener is a nail.

In an embodiment, the sleeve is sized and shaped to accept a rough cut wooden board.

In an embodiment, the sleeve is sized and shaped to accept a wooden board in a standard milled size.

In an embodiment, the standard milled size is selected from the group consisting of 2×2, 2×3, 2×4, 2×6, 2×8, 2×10, 2×12, 1×2, 1×3, 1×4, 1×5, 1×6, 1×8, 1×10, 1×12, and 4×4.

In an embodiment, a board is disposed in the sleeve.

Also described herein, among other things, is a safety handrail system comprising: a walkway; a plurality of handrail support brackets attached to the walkway, each handrail support bracket in the plurality of handrail support brackets comprising a generally C-shaped clamp sized and shaped for removeably attaching to the walkway and a sleeve rigidly attached to the clamp, the sleeve sized and shaped for accepting a handrail post and having a handrail post disposed therein; a handrail attached to a plurality of handrail posts disposed in the sleeves.

In an embodiment, the system further comprises a toe board attached to a plurality of handrail posts disposed in the sleeves.

In an embodiment, the system further comprises a knee board attached to a plurality of handrail posts disposed in the sleeves.

Also described herein, among other things, is a method for erecting a walkway handrail, the method comprising the steps of: providing a walkway; providing a plurality of a handrail support brackets comprising a generally C-shaped clamp sized and shaped for removably attaching to the elevated walkway and a sleeve rigidly attached thereto sized and shaped for accepting a handrail support post; providing a plurality of handrail support posts; providing a plurality of fasteners; providing a handrail; attaching each one of the handrail support brackets in the plurality of handrail support brackets to the walkway; disposing in the sleeve of each one of the handrail support brackets in the plurality of handrail support brackets one handrail support post from the plurality of handrail support posts; fastening each one of the handrail support posts to the sleeve with a fastener from the plurality of fasteners; attaching the handrail to the plurality of handrail support posts; erecting a walkway handrail.

In an embodiment, the method further comprises the steps of: further providing a toe board; attaching the toe board to the plurality of handrail support posts.

In an embodiment, the method further comprises the steps of: further providing a knee board; attaching the knee board to the plurality of handrail support posts.

DESCRIPTION OF THE PREFERRED EMBODIMENT(S)

Figure 1A:
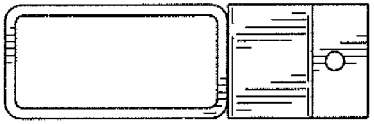
FIGS. 1A-1F provides four isometric views of one embodiment of a safety handrail bracket.
Figure 1B:
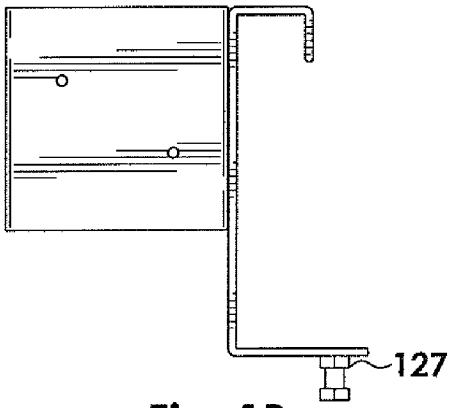
Figure 1C:
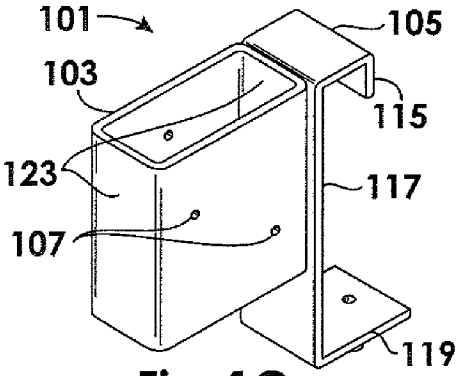
Figure 1D:
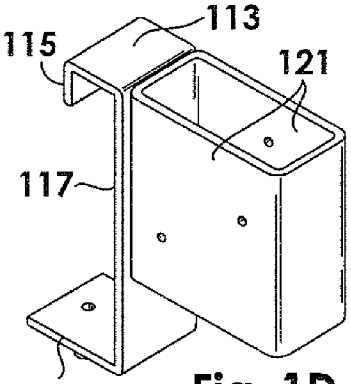
Figure 1E:
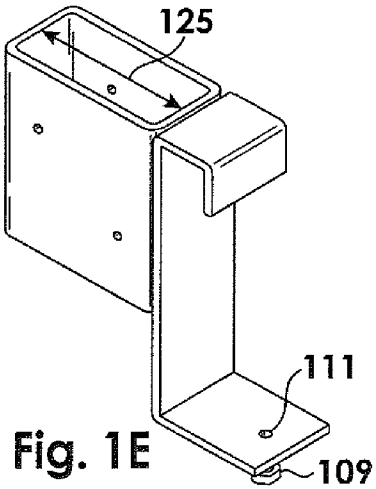
Figure 1F:
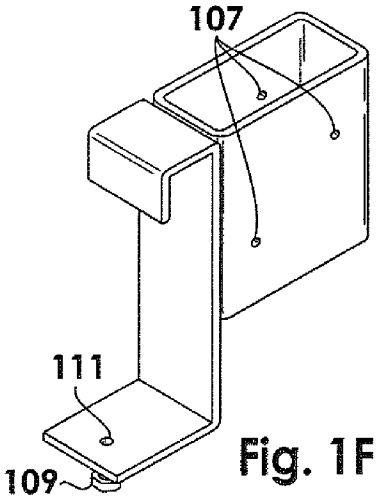

It will be understood by one of ordinary skill in the art that while this disclosure focuses on wooden safety handrails used in conjunction with metal walkways on construction sites and at industrial complexes, the devices, systems, and methods described herein are suitable for use in other applications and with other materials as well, and pertain also thereto.

FIG. 1 depicts an embodiment of a handrail bracket (101) for use in conjunction with a safety handrail attached to a walkway. The depicted embodiment generally comprises a walkway attaching system and a board retention system (103). In an embodiment, the bracket (101) further comprises a fastening system.

In the depicted embodiment of FIG. 1, the walkway attaching system includes a clamp (105) generally in the configuration of an orthogonal C. The depicted clamp (105) includes opposing top (113) and bottom (119) elements of about the same thickness and width arranged generally in parallel and connected by an elongated vertical body (117) of about the same thickness and width as the top (113) and bottom (119). In the depicted bracket (101), the proximal end of the top (113) is connected generally perpendicularly to an end of the body (117) and the proximal end of the bottom (119) also is connected generally perpendicularly to the opposing end of the body (117). Both the top (113) and (119) are attached to the body (117) such that they (113, 119) extend from the same side of the body (117), creating the general shape of an orthogonal C. The depicted embodiment (101) further includes a bracing portion (115) attached to the distal end of the top (113) opposing the body (119), and the bracing portion (115) is generally perpendicularly connected to the top (113) at the proximal end of the brace (115). The depicted brace (115) extends ventrally from the top (113) toward the bottom (119) and is generally parallel to the body (117).

Components (115, 113, 117, 119) of the clamp (105) are constructed of rigid material—including but not limited to aluminum, carbon steel, stainless steel, steel, or an alloy thereof—which resist distortions in shape. Components (115, 113, 117, 119) are also rigidly connected to each other through monolithic construction or bonding techniques known in the art as discussed elsewhere herein.

Figure 2:
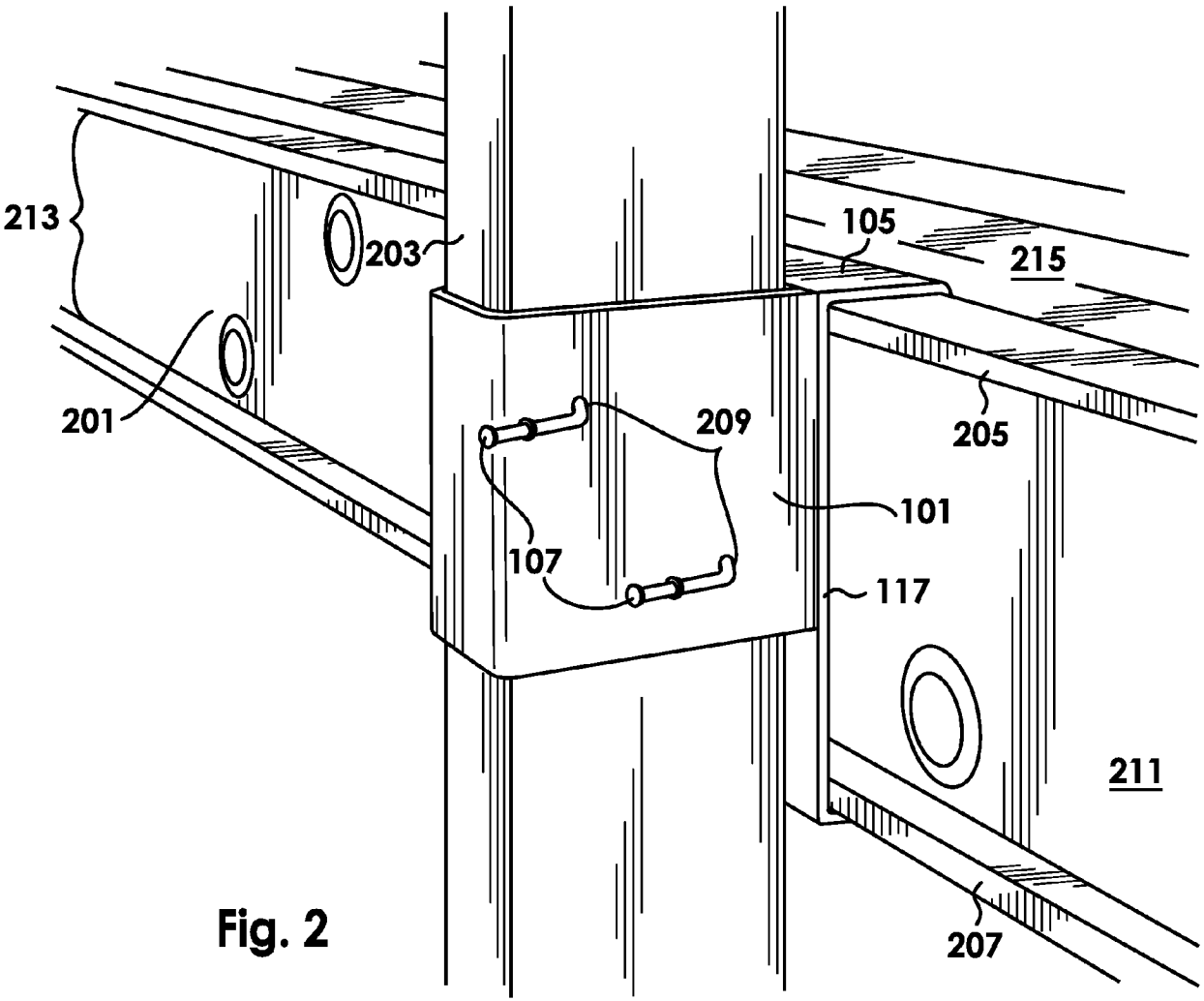
FIG. 2 provides one embodiment of a safety handrail bracket installed on a metal walkway with a safety handrail board inserted therein.

The depicted clamp (105) is sized and shaped for attaching to the side beam (211) of a metal walkway (201) as depicted in FIG. 2. The depicted metal walkway (201) is comprised of two side beams (211) arranged generally in parallel with a walking surface (215) extending therebetween. The depicted side beam (211) is generally in the configuration of an I-beam, but brackets (101) configured for attaching to a differently shaped side beam (211) are specifically contemplated, including without limitation a C-beam. In an embodiment of the bracket (101) used with a walkway having a differently-shaped side beam, or having lateral components other than a beam to which the bracket (101) may be attached, the configuration of the clamp (105) can vary to match the shape and configuration of such beams or other components. Among other things, the length, width, height, and/or thickness of the top (113), bottom (119), body (117), and/or brace (115) may vary from embodiment to embodiment, as may the configuration of these and other elements with respect to one another. In an embodiment, the composition, position, and mechanism of operation for the fastening system may also vary from that depicted.

The side beam (211) generally comprises upper and lower flanges (205, 207) with a web (213) extending therebetween. The depicted clamp (105) is attached to the side beam (211) by placing the interior surface of the brace (115) against the inside lip of the upper flange (205) and sliding the bottom (119) beneath the lower flange (207) until the body (117) contacts the outer lip of one or both flanges (205, 207). In an embodiment having a fastening system, the fastening may be engaged to secure the clamp (105) to the side beam (211). In the depicted embodiment, an attachment bolt (109) may be engaged, as described elsewhere herein. In an embodiment having a fastening system, the fastening system generally is fully or partly disengaged during installation.

The depicted clamp (105) is sized and shaped to establish a snug fit with the side beam (211). Among other things, this snug fit increases the amount of surface area of the clamp (105) and beam (211) in contact, increasing the friction between the clamp (105) and side beam (211), reducing unwanted movement of the clamp (105), in particular along the length of the side beam (211), and increasing the overall stability of the safety handrail system.

In an embodiment, the brace (115) is shorter than the body (117). In an embodiment, the bottom (119) extends further from the body (117) than does the top (113). In an embodiment, the distance between the center of the aperture (111) and the body (117) is greater than the distance between the brace (115) and the body (117). In an embodiment, the top (113) has a thickness of about 0.125 inches. In an embodiment, the top (113) is about 1.25 inches long. In an embodiment, the bottom (119) has a thickness of about 0.125 inches. In an embodiment, the bottom (119) is about 2.375 inches long. In an embodiment, the brace (115) has a thickness of about 0.125 inches. In an embodiment, the brace (115) is about 0.875 inches long. In an embodiment, the body (117) of the walkway attaching element (105) has a thickness of about 0.125 inches. In an embodiment, the body (117) is about 6 inches long. In an embodiment, the clamp (105) is about 2 inches wide. In an embodiment, the top (113), bottom (117), body (119), and/or brace (115) are about 2 inches wide.

The specific dimensions of a bracket (101) will vary depending on the particular walkway with which the bracket is intended to be used. It is specifically contemplated that the bracket (101) may be used on walkways of differing widths and configurations, and that the dimension of the bracket (101) may vary. It is specifically contemplated that the bracket (101) may be used with at least three different sizes of walkway, and the dimensions of each embodiment of the bracket (101) for use with each size walkway may vary, including but not limited to length and width.

In an embodiment, the clamp (105) includes a fastening system. In the depicted embodiment of FIG. 1, the fastening system includes an attachment bolt (109) and an aperture (111) sized and shaped for accepting an attachment bolt (109). The aperture (111) may be threaded in a matter configured to interlock with the threads of an attachment bolt (109). In another embodiment, the fastening system further comprises a nut (127) affixed to the exterior surface of the bottom (119) such that the nut (127) circumscribes the aperture (111). In such an embodiment, the aperture (111) may, but need not, be threaded, as the nut (127) provides threads to interlock with the attachment bolt (109).

Figure 3:
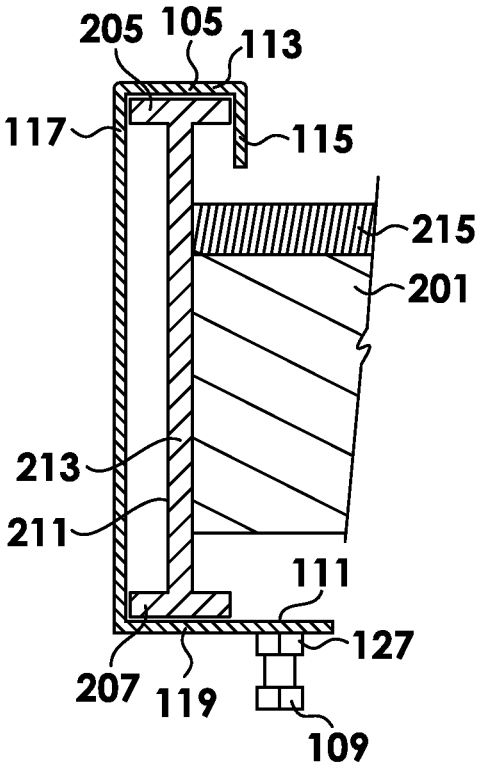
FIG. 3 provides a schematic cross-sectional view of one embodiment of a safety handrail bracket attached to a walkway.

FIG. 3 depicts a cross-sectional view of an embodiment of the bracket (101) attached to a side beam (211) with an attachment bolt (109) disengaged. In the depicted embodiment, the attachment bolt (109) braces the bottom (119) against the side beam (211) by, when engaged, protruding from the interior surface of the bottom (119) near the inner edge of the lower flange (207). When the attachment bolt (109) is properly engaged, the clamp (105) may be removed from the side beam (211) after at least partially retreating the attachment bolt (109) from the aperture (211). The rigid construction of the depicted clamp (105) is not easily distorted, and a properly constructed, installed and maintained clamp (105) generally will not inadvertently or spontaneously detach from the side beam (211) under normal conditions.

When the bolt (109) is retreated from the aperture, the bottom (119) of the clamp (105) presents a generally smooth interior surface which, when the clamp (105) is being attached to the walkway (201), slides along the lower flange (207) of the side beam (211) until the aperture is (111) not blocked by the flange (207). The bolt (109) may then be screwed into the aperture (111) until the distal end of the bolt (109) fully penetrates the aperture (111), securing the clamp (105) to the side beam (201) in a manner similar to the brace (115). The size, shape, and placement of the aperture (111) may vary from embodiment to embodiment, depending upon, among other things, the fastening system or hardware with which the bracket (101) will be used, or the configuration of the particular walkway (201) with which the bracket (101) will be used, including but not limited to side beams (211) in different configurations, or a walkway having different lateral components to which the bracket (101) may be attached.

It is generally preferred that the aperture (111) be placed such that the distance between the body (117) and the aperture (111) is about the same or greater in length as the length of the lower flange (207) of the side beam (211). This configuration presents a snug fit which discourages movement of the bracket (101) when attached to the walkway (201), increasing overall stability of the system. The bracket (101) can be removed from the walkway (201) by unscrewing, loosening, or otherwise disengaging the attachment bolt (109).

This technique is also preferred because it does not require permanent alteration or modification of the walkway (201), such as by boring holes. Such modifications may weaken the walkway or may damage rented, leased, or borrowed walkways (201). Although the fastening system is described in particular reference to an attachment bolt (109), any fastening systems or fasteners now known or in the future developed is contemplated.

In an embodiment, the fasting system includes a 5/16" attachment bolt (109) and a 5/16" nut (127) welded to the bottom (119) of the clamp (105) such that the 5/16" welded nut (127) circumscribes the aperture (111) in the bottom (119). In an embodiment, the aperture (111) is located about one inch from a lateral edge of the bottom (119). In an embodiment, the aperture (111) is located about 0.6248 inches from the distal end of the bottom (119). In an embodiment, the aperture (111) has a radius of about 0.324 inches.

In the depicted embodiment of FIG. 1, the board retention system includes a sleeve (103) sized and shaped for accepting a wooden board. The depicted sleeve (103) is generally in the configuration of a hollow rectangular prism having two sets of opposing sides (121, 123) connected at the ends to form a sleeve (103) open at opposing top and bottom sides such that a board (203) may be inserted through the sleeve (103) as depicted in FIG. 2. The sleeve (103) generally is sized and shaped to accommodate a particular size of board (203) and generally will be sized and shaped for standard mill cuts, including but not limited to 2×2, 2×3, 2×4, 2×6, 2×8, 2×10, 2×12, 1×2, 1×3, 1×4, 1×5, 1×6, 1×8, 1×10, 1×12, and 4×4, as will be understood by those of ordinary skill in the art. Sleeves (103) sized and shaped to accept rough and milled cuts of these and other dimensions of wood are specifically contemplated.

It is desirable that the fit between the sleeve (103) and board (203) is generally snug, allowing the board (203) to be inserted into the sleeve (103) with little or modest effort but allowing little movement of the board (203) once placed in the sleeve (103). However, there is variance in the actual dimensions of wooden boards caused by, among other things, ambient conditions such as temperature and humidity, distortions in the shape of a board as it acclimates, blade kerf, and milling. As such, some lateral movement of the board (203) is expected and anticipated, and in some cases, this movement may be significant. Where a board (203) is susceptible of more movement in a sleeve (103) than is desired, the undesired movement may be reduced in whole or part through use of wood shims (not depicted) inserted into the sleeve (103) between the sleeve (103) and the board (203), and/or other techniques known in the art to reduce wood movement. Shims are generally inexpensive and already present at most job sites using lumber, and are also quick and simple to insert and remove without causing or requiring alterations to the walkway (201), board (203), bracket (101), or any other component.

In the depicted embodiment, the sleeve (103) is rigidly attached to the clamp (105). As depicted, one of the short sides (123) is affixed to the exterior of the body (117) of the clamp (105). This allows the open end of the clamp (105) to be attached to the walkway (201) without the sleeve (103) interfering with the connection. The short side (123) of the depicted sleeve (103) is about as wide as the clamp (105) such that when the short side (123) is attached to the clamp (105) the long sides (121) are generally coplanar with the lateral edges of the clamp (103).

In the depicted embodiment, a short side (123) of the sleeve (103) is attached to the clamp (105) so that the orientation of the board (203) with respect to the walkway (201) is such that the thicker dimension of the board (203) is generally perpendicular to the side beam. For example, where the board (203) is a milled 2×4, the thicker four inch dimension is generally perpendicular to the side beam (211) as depicted in FIG. 2. This orientation generally is preferred due to its increased resilience. Pressure on the handrail system will generally be applied by pushing the handrail outward from the center of the walkway (201) or pulling it inward towards the center of the walkway (201). This directional force is transferred to the boards (203) and applied to the board's (203) lateral connection to the short sides (123) of the sleeve (103). By orienting the board (203) such that the longer dimension is parallel to this directional force, the bracket (101) increases the amount of wood absorbing the force and increases the amount of force that may be applied to the system without damaging, breaking, or otherwise compromising the board (203) or system.

The sleeve (103) is generally constructed of rigid material—including but not limited to aluminum, carbon steel, stainless steel, steel, or an alloy thereof—which resists distortions in shape. The sleeve (103) is rigidly mated to clamp (105) through any technique now known or later developed in the art, including without limitation: monolithic construction or manufacture; welding; riveting; hardware; adhesives including but not limited to cement, epoxies, urethanes, and acrylics; mechanical fasteners; and/or a combination of these or other techniques.

The depicted sleeve (103) is further comprised of one or more apertures (107) through which a fastener may be inserted to reduce or prevent vertical movement of the board (203) in the sleeve (103). The depicted embodiment of FIG. 1 includes apertures (107) arranged in corresponding positions on opposing surfaces (121) of the sleeve (103) such that a fastener driven generally perpendicularly through one aperture (107) will pass through a board (203) inserted in the sleeve (103) and through an aperture (107) in the opposing surface (121). The fastener may be secured in any manner known in the art, including but not limited to by introducing an angle or bend to the fastener, or through the attaching of additional hardware, such as a nut and/or washer. In an embodiment, the fastener is a nail (209), such as depicted in FIG. 2, and is secured to the sleeve (103) by bending the nail (209).

The dimension, location, and quantity of apertures (107) may vary from embodiment to embodiment depending upon, among other things, the size, shape, and composition of material with which the bracket (101) is to be used. In an embodiment configured for use with a common 2×4 board (203), two sets of apertures (107) may be sufficient to secure the board (203). In an embodiment, an aperture (107) does not have a corresponding aperture (107) on an opposing surface (121). Although generally circular apertures (107) are depicted, in an embodiment an aperture (107) may have another shape, such as to accommodate a fastener whose body is not cylindrical. By way of example and not limitation, in an embodiment an aperture (107) is generally in the shape of a polygon.

In the depicted embodiment, an aperture (107) has a diameter of about 0.1875 inches. In an embodiment, an aperture (107) is located on a surface (121) of the sleeve (103) about one and a third inches from an open end of the sleeve (103). In an embodiment, an aperture (107) is located on a surface (121) of the sleeve (103) about 1 inch from the side (123) attached to the clamp (105). In an embodiment, an aperture (107) is located about 1 inch from a side (123) opposite the clamp (105). In an embodiment, an end of the sleeve is (103) closed and forms a base preventing the board (203) from sliding downward through the sleeve (103).

In an embodiment, the sleeve (103) is about 0.1875 inches thick. In an embodiment, a side of the sleeve (103) has an interior length of about 3.625 inches. In an embodiment, a side of the sleeve (103) has an interior length of about 1.6250 inches. In an embodiment a side of the sleeve (103) has an exterior length of about 4 inches. In an embodiment a side of the sleeve (103) has an exterior length of about 2 inches. In an embodiment, the sleeve (103) has a height of about 4 inches.

Figure 4:
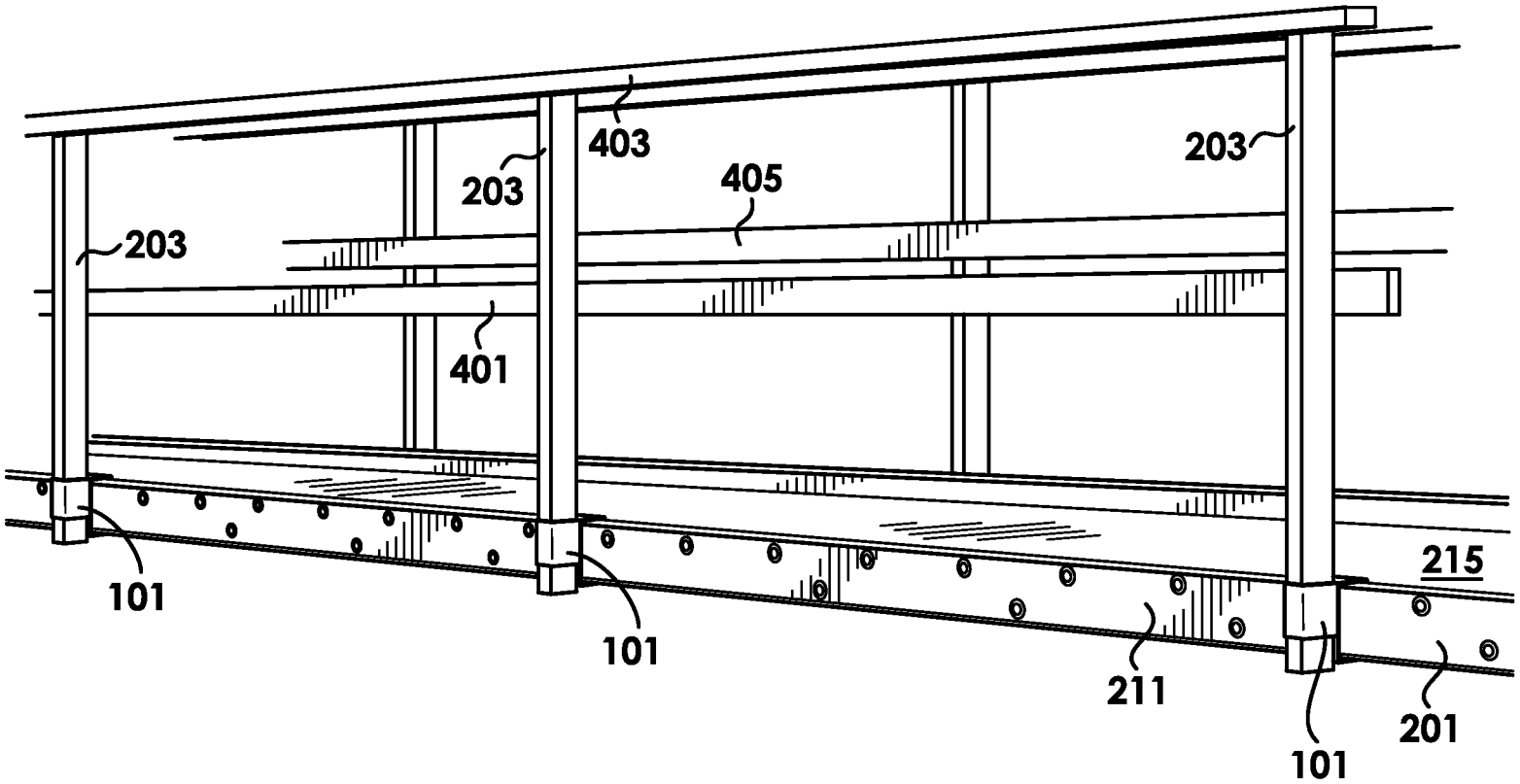
FIG. 4 provides a safety handrail system deployed on a metal walkway with embodiments of a safety handrail bracket.

FIG. 4 depicts an embodiment of a handrail system (401) erected using an embodiment of the bracket (101). In the depicted embodiment, a plurality of brackets (101) are attached to a side beam (211) as described herein, and a safety handrail support post, including without limitation a wooden board (203), is disposed in the sleeves (103) of each such bracket (101) and secured therein as described herein. The posts need not be the same length, but will generally be disposed such that the tops of the posts are generally coplanar, and the plane generally formed by the tops of the posts is generally parallel to the walking surface (215) of the walkway (201). A safety handrail (403) is then attached to the tops of the posts, generally parallel to the walking surface (215), such as through use of hardware, including but not limited to nails. The safety handrail is (403) is generally, but need not be, a wooden board.

In an embodiment, a kick plate or toe board (407) may also be attached to the posts (203) to prevent tools from being kicked or knocked off the walkway (201). It is well understood in the art that a kick plate (407) is attached near the walking surface (215) at a suitable height to reduce the likelihood of tools or equipment falling from the walkway (201), and is sized and shaped to that end. In an embodiment, a knee board (405) may also be installed by attaching it to the posts (203). The knee board (405) both improves the stability of the handrail system (401) and provides additional protection from slips and falls, particularly for workers who are sitting, kneeling, or crouching on the walkway (201), and who would otherwise be low enough to the walking surface (215) and if the handrail (403) were too high up to prevent a fall from the walkway (201) between the kick plate (407) and the handrail (403).

The number and placement of brackets (101) and boards (203) will necessarily vary from embodiment to embodiment, and from application to application. Factors including but not limited to the size and shape of the lumber and walkway may favor closer or further spacing of the brackets (101). In an embodiment, the brackets (101) and posts spaced as required by applicable regulations and published safety guidelines.

Although the depicted embodiments generally contemplate an orthogonal structure, angular structures are also specifically contemplated. For example, in an embodiment it may be desirable that the sleeve be attached to the clamp out of square, or at an angle, such as where the walkway to which the device will be attached is itself on an angle and, in order to present a handrail post that is generally upright, the sleeve's attachment angle with respect to the clamp must vary. In an alternative embodiment, where the sleeve is not rigidly attached to the clamp. In a still further embodiment, the sleeve can rotate with respect to the clamp and be locked or set at a particular angle with respect to the clamp.

In an embodiment, the attachment bolt is located positioned on the brace, or on another component such that the bolt, when fastened, reduces movement of the clamp through friction with the walkway or a component thereof, such as a top or bottom surface of a flange.

Although the depicted embodiments contemplate a device with generally uniform thickness, in an embodiment, the thickness of the surfaces may vary. In an embodiment, the device is made, in whole or part, from aluminum, stainless steel, steel, carbon steel, or an alloy thereof.

Although the device has generally been described in conjunction with wood boards, the devices, systems, and methods described herein are suitable for use with any material in any shape or size. By way of example and not limitation, the devices, systems, and methods described herein may be sized and shaped to accept a round post made of a metal or metal alloy or a plastic or other polymer including but not limited to PVC. The use of wood in configurations other than boards is also specifically contemplated.

Although the devices, systems, and methods described herein have generally been disclosed in connection with safety handrails, the devices, systems, and methods are suitable for use with other types of structures as well, including but not limited to structures for storing or hanging tools, materials, or devices, and supports for wires, cables, or lines.

Although the devices, systems, and methods described herein have generally been described in connection with a safety walkway in an industrial or construction site, the devices, systems, and methods are suitable for use in any context in which it is desirable to affix a post or board to a structure without modifying the structure. By way of example and not limitation, the devices, systems, and methods described herein may be used in an embodiment to extend a structure beneath a walkway to establish an under-mounted storage compartment or other enclosure.

While the invention has been disclosed in connection with certain preferred embodiments, this should not be taken as a limitation to all of the provided details. Modifications and variations of the described embodiments may be made without departing from the spirit and scope of the invention, and other embodiments should be understood to be encompassed in the present disclosure as would be understood by those of ordinary skill in the art.

The invention claimed is:

1. A bracket for attaching a safety handrail to a walkway comprising:

a generally C-shaped clamp comprising:

a vertical body portion generally in the configuration of a rectangular prism and having a vertical body portion length defining the length of the major axis of said vertical body portion, said vertical body portion having opposing top and bottom ends and opposing front and back sides;

a top lateral portion generally in the configuration of a rectangular prism and having opposing proximal and distal ends and rigidly and perpendicularly attached to said top end of said vertical body portion at said proximal end of said top lateral portion such that said top lateral portion extends laterally from said front side of said vertical body portion, said top lateral portion having a top lateral portion length and being about the same thickness as said vertical body portion;

a bottom lateral portion generally in the configuration of a rectangular prism and having opposing proximal and distal ends and rigidly and perpendicularly attached to said bottom end of said vertical body portion at said proximal end of said bottom lateral portion such that said bottom lateral portion extends laterally from said front side of said vertical body portion and is generally parallel to said top lateral portion, said bottom lateral portion having a bottom lateral portion length longer than said top lateral portion length and extending further from said vertical body portion than said top lateral portion, and said bottom lateral portion being about the same thickness as said vertical body portion, said bottom lateral portion having an aperture disposed through said bottom lateral portion at a distance from said vertical body portion farther than the length of said top lateral portion, said aperture being sized and shaped to accept a fastener;

a rectangular brace generally in the configuration of a rectangular prism and having opposing proximal and distal ends and rigidly and perpendicularly attached to said distal end of said top lateral portion at said proximal end of said rectangular brace, said rectangular brace extending from said top lateral portion toward said bottom lateral portion, and said rectangular brace being about the same thickness as said vertical body portion;

a retaining sleeve comprising two opposing long sides and two opposing short sides, said long sides and said short sides connected at corners to form a hollow generally rectangular prism having an open top side and opposing open bottom side, one of said two short sides being generally the same width as said vertical body portion and coplanar with and rigidly attached to said back of said body such that when an elongated generally linear board is inserted into said sleeve through said open top side said board is generally parallel to said vertical body portion, and said open top side being generally coplanar with said top lateral portion, and said open bottom side being at a location on said vertical body portion between said top portion and said bottom portion, and the thickness of said four sides of said sleeve being about the same as the thickness of said vertical body portion.

2. The bracket as claimed in claim 1, wherein a fastener inserted through said aperture must be at least partially withdrawn before said clamp is removed from said walkway.

3. The bracket as claimed in claim 1, wherein said sleeve further comprises a plurality of apertures sized and shaped to accommodate a fastener, said plurality of apertures positioned on said sleeve such that when a board is in said sleeve, a fastener inserted through each of said plurality of apertures will penetrate said board.

4. The bracket as claimed in claim 1, wherein said sleeve is sized and shaped to accept a rough cut wooden board.

5. The bracket as claimed in claim 1, wherein said sleeve is sized and shaped to accept a wooden board in a standard milled size.

6. The bracket as claimed in claim 5, wherein said sleeve is sized and shaped to accept a wooden board in a standard milled size selected from the group consisting of 2×2, 2×3, 2×4, 2×6, 2×8, 2×10, 2×12, 1×2, 1×3, 1×4, 1×5, 1×6, 1×8, 1×10, 1×12, and 4×4.

* * * * *